US007878761B1

(12) United States Patent
Liang

(10) Patent No.: US 7,878,761 B1
(45) Date of Patent: Feb. 1, 2011

(54) TURBINE BLADE WITH A SHOWERHEAD FILM COOLING HOLE ARRANGEMENT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 816 days.

(21) Appl. No.: 11/900,035

(22) Filed: Sep. 7, 2007

(51) Int. Cl.
*F01D 5/18* (2006.01)

(52) U.S. Cl. ..... 416/97 R

(58) Field of Classification Search ..... 415/115; 416/97 R

See application file for complete search history.

(56) References Cited

U.S. PATENT DOCUMENTS 5,374,162 A * 12/1994 Green ..... 416/97 R
5,486,093 A * 1/1996 Auxier et al. ..... 416/97 R
5,496,151 A 3/1996 Coudray et al.
6,099,251 A 8/2000 LaFleur
6,164,912 A 12/2000 Tabbita et al.
6,196,798 B1 * 3/2001 Fukuno et al. ..... 416/97 R
7,114,923 B2 10/2006 Liang
7,246,992 B2 * 7/2007 Lee ..... 415/115
7,500,823 B2 * 3/2009 Bolms et al. ..... 415/115

* cited by examiner

*Primary Examiner*—Ninh H Nguyen
(74) *Attorney, Agent, or Firm*—John Ryznic

(57) ABSTRACT

A turbine rotor blade used in a gas turbine engine, the blade including a showerhead arrangement of film cooling holes on the leading edge to provide a uniform layer of film cooling air over the leading edge surface. The showerhead includes three rows of film holes with a middle row located along the stagnation line, and the other two rows located on the pressure side and the suction side from the stagnation row. The stagnation row of film holes has a cooling air ejection angle greater than the ejection angles of the other two rows. Also, the openings adjacent holes in the three rows have bottoms that are aligned with each other in the blade spanwise direction. The outlet opening of the stagnation holes have a longer length in the spanwise direction than do the opening holes of the pressure side and suction side film holes. Because of the different ejection angles and the alignment of the bottoms of the film holes on the leading edge surface, a more uniform layer of film cooling air is provided for over the leading edge surface of the blade.

9 Claims, 3 Drawing Sheets

View A-A

View B-B

View C-C

View D-D

View E-E

TURBINE BLADE WITH A SHOWERHEAD FILM COOLING HOLE ARRANGEMENT

BACKGROUND OF THE INVENTION

1. Field of the Invention

The present invention relates generally to fluid reaction surfaces, and more specifically to a turbine blade with leading edge cooling.

2. Description of the Related Art including information disclosed under 37 CFR 1.97 and 1.98

In a gas turbine engine, a combustor produces a extremely high temperature gas flow that is passed through a turbine to produce mechanical power. The turbine typically includes multiple stages or stator guide vanes and rotor blades that are exposed to the hot gas flow. The first stage stator vanes and rotor blades are exposed to the highest temperature, since the temperature progressively decreases as the hot gas flow passes through the turbine stages and energy is extracted from the flow.

It is well known in the art of gas turbine engines that the engine efficiency can be increased by increasing the inlet temperature of the hot gas flow into the turbine. A higher gas flow temperature means higher energy content in the flow. However, the limiting temperature entering the turbine first stage is dependent upon the material characteristics of the vanes and blades as well as the cooling capability. Thus, the turbine inlet temperature can be increased with improved materials and/or improved cooling.

A turbine blade or vane will be exposed to different levels of temperature throughout the airfoil surface. Complex internal cooling passages are designed so that adequate cooling of each surface of the airfoil can be accomplished. In an area where too little cooling is produced, a hot spot can occur in which erosion or oxidation of the airfoil surface will occur and lead to damaged airfoils. Especially in an industrial gas turbine engine, where the engine can operate continuously for 48,000 hours, a damaged airfoil may result in premature stopping of the engine for repairs or a damaged airfoil that will result in lower performance of the engine. Thus, to provide for long engine runs and long part life, the turbine vanes and blades require maximum cooling over all the surfaces and minimal amounts of cooling air to provide for an increased efficiency of the engine.

The highest heat load applied to the stator vanes and the rotor blades occur on the leading edge of the airfoil, since this area of the airfoil is exposed directly head-on to the hot gas flow. In the prior art, a blade leading edge showerhead comprises three rows of film cooling holes. The middle film row is positioned at the airfoil stagnation point where the highest heat load occurs on the airfoil leading edge. Film cooling holes for each film row are at an inline pattern and inclined at 20 to 35 degrees relative to the blade leading edge radial surface. FIGS. 1 and 2 show a cutaway view of the prior art blade leading edge showerhead film cooling hole arrangement. A fundamental shortfall associated with this prior art showerhead arrangement is the over-lapping of film ejection flow in a rotational environment such as a rotor blade. Stator vanes do not rotate, and therefore this problem is not the same as with rotor blades because of the centrifugal forces associated with the cooling air ejection from the film cooling holes. As a result of the prior art film hole arrangement, a hot streak is developed as shown in-between the film holes of FIG. 4 which shows the film trace for the turbine blade showerhead of the prior art.

One prior art reference, U.S. Pat. No. 7,114,923 B2 issued to Liang on Oct. 3, 2006 and entitled COOLING SYSTEM FOR A SHOWERHEAD OF A TURBINE BLADE, discloses a showerhead arrangement in which the film cooling holes are extending at various angles relative to each other in order to reduce the likelihood of zipper effect cracking in the leading edge and to effectively cool the leading edge of the turbine blade. The Liang U.S. Pat. No. 7,114,923 is incorporated herein by reference in its entirety.

It is therefore an object of the present invention to provide for a turbine blade with a showerhead arrangement of film cooling holes that will produce a more effective film cooling covering of the leading edge than the cited prior art references.

BRIEF SUMMARY OF THE INVENTION

A turbine rotor blade with a showerhead arrangement of film cooling holes. The showerhead includes a row of film holes along the stagnation point of the airfoil leading edge, a row of pressure side film holes and a row of suction side film holes on the adjacent sides from the stagnation row. A stagnation hole is positioned along the stagnation line and includes a bottom edge of the hole. Both the pressure side and the suction side film holes have a bottom edge aligned with the bottom edge of the stagnation film hole in the blade chordwise direction. Each of the three adjacent film holes in the showerhead has the bottom surfaces aligned with each other in the chordwise direction of the airfoil. The chordwise length of the stagnation film holes is longer than the chordwise length of the pressure and suction film holes. The injection angle of the stagnation film holes is angled greater in the direction of the blade tip than the ejection angles of the pressure side and suction side film holes in order to eliminate the spacing issue in-between film holes.

With the showerhead arrangement, the centerline for the film hole entrance point is no longer inline similar to the film hole exit or inline with the oncoming heat load to the airfoil leading edge. As a result, the cooling flow ejection angle for the stagnation film row is no longer the same as the film rows for the blade leading edge pressure and suction side rows. This eliminates the film over-lapping problem of the prior art and yields a uniform film layer for the blade leading edge region. The showerhead arrangement of the present invention increases the blade leading film effectiveness to the level above the prior art showerhead and improves the overall convection capability which reduces the blade leading edge metal temperature.

DETAILED DESCRIPTION OF THE INVENTION

Figure 1:
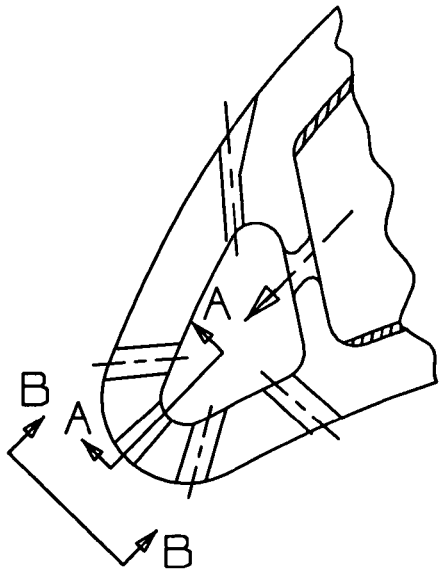
Fig 1 Prior Art
FIG. 1 shows a cross section view of a prior art showerhead with three rows of film cooling holes.
Figure 2:
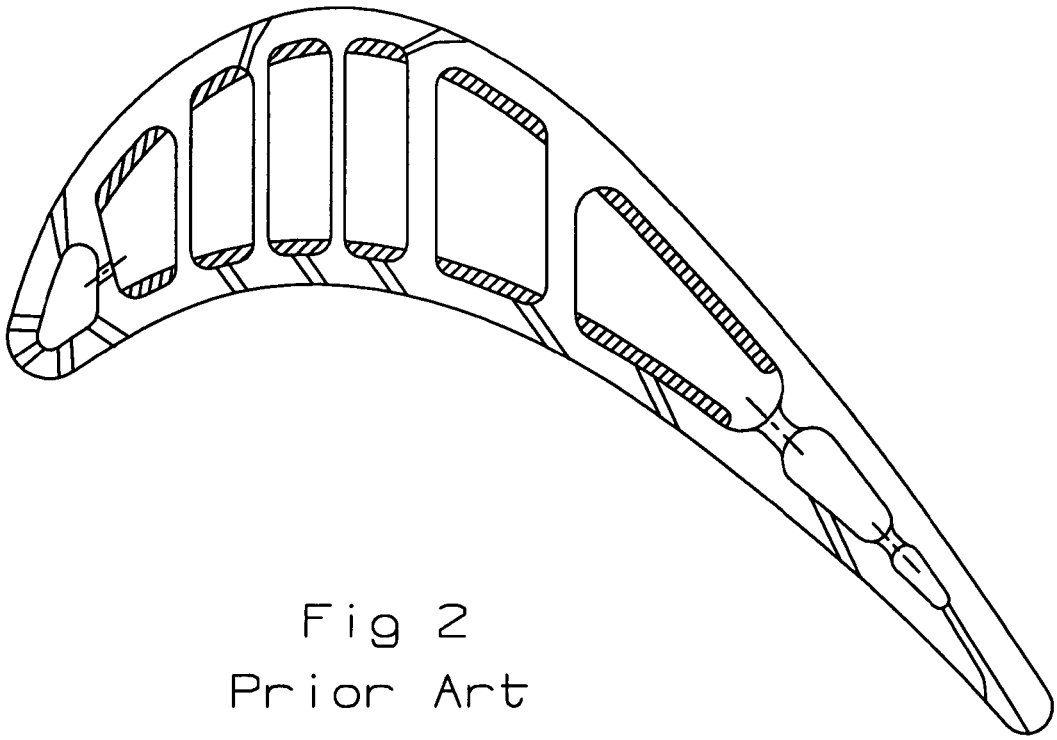
Fig 2 Prior Art
FIG. 2 shows a cross section view of a prior art turbine blade with the showerhead of FIG. 1.
Figure 3:
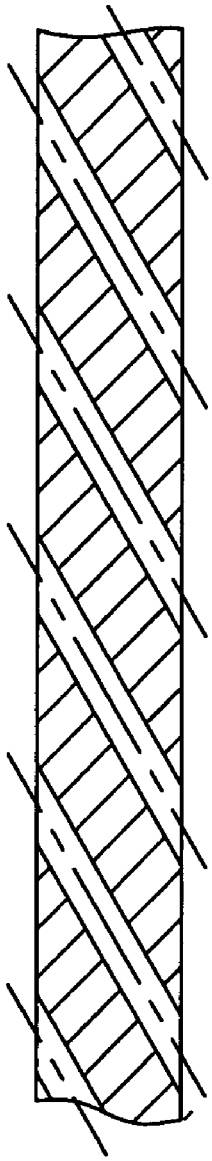
Fig 3 Prior Art
FIG. 3 shows a cut-away view of the middle row of holes in the FIG. 1 showerhead arrangement.
Figure 4:
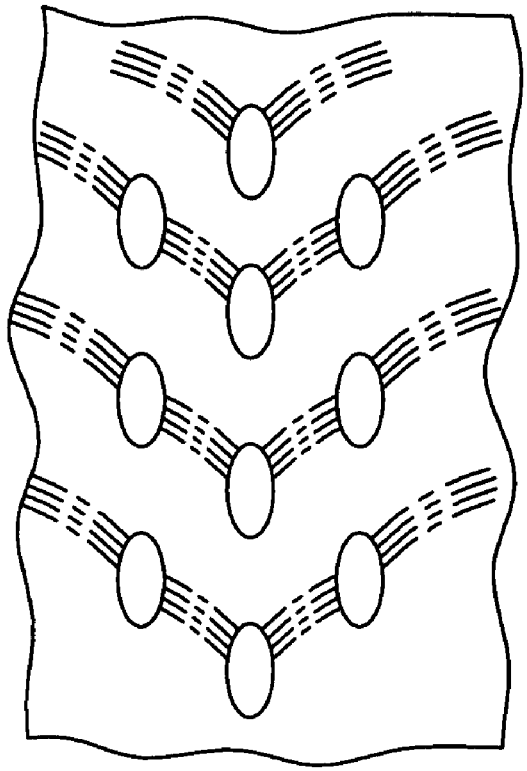
Fig 4 Prior Art
FIG. 4 shows a front view of the showerhead arrangement of the prior art in FIG. 1.
Figure 5:
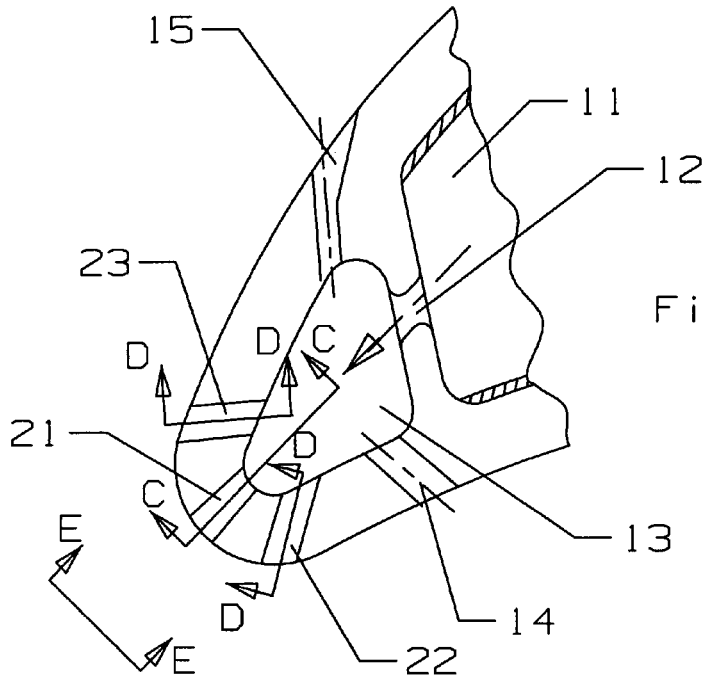
FIG. 5 shows a cross section view of the showerhead arrangement of the present invention.

A turbine rotor blade includes a showerhead arrangement of film cooling holes to provide a film layer of cooling air to the leading edge of the blade. FIG. 5 shows a cut-away view of the showerhead of the present invention and includes a cooling supply channel 11 to supply cooling air to the showerhead, a metering and diffusion hole 12 to connect the cooling air supply channel to a leading edge impingement cavity 13, a pressure side gill hole 14 and a suction side gill hole 15, a row of film holes 21 at the stagnation point, a row of film holes 22 on the pressure side of the leading edge, and a row of film hole 23 on the suction side of the leading edge. The main features of the present invention are the angles of the three rows of film holes that make up the showerhead. In a turbine rotor blade, in which centrifugal forces from rotation effect the discharge directions of the cooling air ejected from the film cooling holes, the arrangement and orientation of the showerhead film holes will be different than in a stator guide vane.

Figure 6:
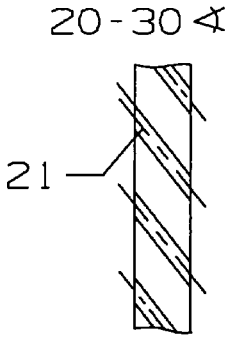
FIG. 6 shows a cut-away view of the middle or stagnation row in the showerhead of the present invention.
Figure 7:
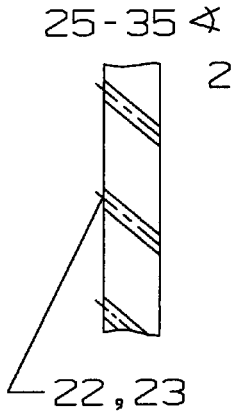
FIG. 7 shows a cut-away view of the pressure side and suction side film cooling holes of the present invention.

FIG. 6 shows a cut-away view of the row of stagnation point film holes 21 in the showerhead of FIG. 5. FIG. 7 shows a cut-away view of the row of pressure side 22 or suction side 23 film holes in the showerhead of FIG. 5. The row of stagnation point film holes 21 has less of an angle than the two rows of pressure side and suction side film holes 22 and 23 as seen in FIGS. 6 and 7. The stagnation row of film holes 21 can be from 20 to 30 degrees relative to the blade leading edge radial surface. The pressure side and the suction side film holes 22 and 23 can be from 25 to 35 degrees with respect to the same radial surface.

Figure 8:
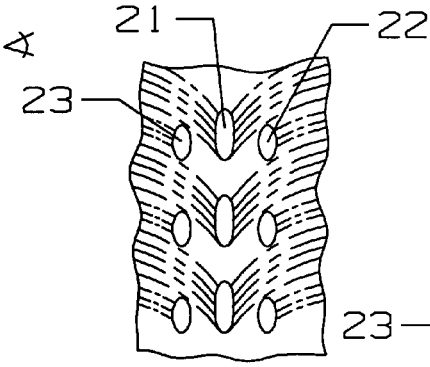
FIG. 8 shows a front view of the openings of the showerhead film holes of the present invention.

Another feature of the showerhead arrangement of the present invention is shown in FIG. 8 in which the stagnation film holes 21 have a width along the spanwise direction of the airfoil greater than the width of the two pressure side and suction side film holes. FIG. 8 shows the openings of the showerhead film holes on the outer surface of the leading edge. Also seen in FIG. 8 is that the bottoms of the holes for all three rows are at the same radial spanwise position for any adjacent three film holes. The arrangement of the three film holes as seen in FIG. 8 is referred to as an in-line array of film holes. Because of the different ejection angles and the hole bottoms being aligned in the spanwise direction, the showerhead holes eject cooling air from the stagnation holes without overlapping the film cooling air ejected from the pressure side or the suction side film holes. Thus, complete film coverage is provided for on the airfoil leading edge.

Figure 9:
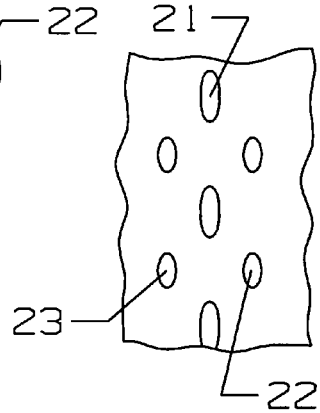
FIG. 9 shows a rear view of the inlets of the showerhead film holes of the present invention.

FIG. 9 shows another feature of the showerhead arrangement of the present invention. The inlet for the three rows of film holes that make up the showerhead are shown in FIG. 9 from inside the surface of the impingement cavity 13 of FIG. 5. The pressure side and suction side film rows are staggered from the row of stagnation film holes in order to accommodate for the different ejection angles of the film holes. The arrangement of the three film holes as seen in FIG. 9 is referred to as a staggered array of film holes. Thus, the outlet openings of the film holes are in-line array while the inlet openings are at a staggered array in order to produce the complete film coverage of the leading edge.

Due to the in-line array of film holes, the larger chordwise length of the opening for the stagnation film holes, and the different angles of cooling air ejection, the film layer of cooling air ejected from the stagnation film holes will flow in-between the film layer ejected from the pressure side and suction side film holes and produce a more complete film coverage of the airfoil leading edge than does the showerhead arrangement for the prior art blades cited above. As a result, the blade leading edge metal temperature can be reduced which would allow for a higher turbine inlet temperature and allow for longer part life of the blade.

I claim the following:

1. A turbine rotor blade for use in a gas turbine engine, the blade comprising:

an airfoil with a leading edge exposed to a high temperature gas flow;

an impingement cavity formed along the leading edge of the airfoil;

a showerhead arrangement of film cooling holes connected to the impingement cavity;

the showerhead including a middle row of film cooling holes positioned along the stagnation line of the leading edge, a pressure side row of film cooling holes, and a suction side of film cooling holes; and, an ejection angle of the stagnation film holes is substantially different than an ejection angle of the pressure side and the suction side film holes with the injection angles measured in a radial direction of the airfoil leading edge.

2. The turbine rotor blade of claim 1, and further comprising:

a difference between the ejection angle of the stagnation film holes and the pressure and suction side film holes is around 5 degrees.

3. The turbine rotor blade of claim 1, and further comprising:

the stagnation film holes have an ejection angle of from about 20 degrees to about 30 degrees relative to the blade leading edge radial surface;

the pressure side and the suction side film holes have an ejection angle of from about 25 degrees to about 35 degrees relative to the blade leading edge radial surface; and, a difference between the ejection angle of the stagnation film holes and the pressure and suction side film holes is around 5 degrees.

4. The turbine rotor blade of claim 1, and further comprising:

the bottoms of the stagnation film holes are aligned with the bottoms of the pressure side and the suction side film holes in a spanwise direction of the leading edge.

5. The turbine rotor blade of claim 4, and further comprising:

an opening of the stagnation film holes has a longer length in the airfoil spanwise direction than the openings of the pressure side and the suction side film holes.

6. The turbine rotor blade of claim 5, and further comprising:

the stagnation film holes have an ejection angle of from about 20 degrees to about 30 degrees relative to the blade leading edge radial surface;

the pressure side and the suction side film holes have an ejection angle of from about 25 degrees to about 35 degrees relative to the blade leading edge radial surface; and, a difference between the ejection angle of the stagnation film holes and the pressure and suction side film holes is around 5 degrees.

7. The turbine rotor blade of claim 1, and further comprising:

an inlet opening of the showerhead film holes are arranged along a staggered array on the inner surface of the impingement cavity; and, the outlet openings of the showerhead film holes are arranged along an in-line array on the leading edge surface of the airfoil.

8. A process for cooling a leading edge of an airfoil surface on a turbine rotor blade, the process comprising the steps of:

ejecting cooling air at a first angle in a radial direction of the airfoil leading edge through a first row of film cooling holes located along a stagnation line of the airfoil;

ejecting cooling air at a second angle in a radial direction of the airfoil leading edge through a second row of film cooling holes located on a pressure side of the leading edge; and, ejecting cooling air at the second angle through a third row of film cooling holes located on a suction side of the leading edge, wherein the first angle is about 5 degrees greater than the second angle.

9. The process for cooling a leading edge of an airfoil surface of claim 8, and further comprising the step of:

ejecting cooling air from the three rows in which the bottoms of the hole openings are aligned in the airfoil spanwise direction.

* * * * *